United States Patent [19]

Schildbach

[11] 4,118,845

[45] Oct. 10, 1978

[54] APPARATUS FOR PRODUCING FINE METAL FILAMENTS

[75] Inventor: August J. Schildbach, Concord, Mass.

[73] Assignee: Brunswick Corporation, Skokie, Ill.

[21] Appl. No.: 695,079

[22] Filed: Jun. 11, 1976

Related U.S. Application Data

[62] Division of Ser. No. 811,780, Apr. 1, 1969, Pat. No. 3,977,070.

[51] Int. Cl.[2] ..... B21B 15/00; B23P 17/00

[52] U.S. Cl. ..... 29/33 K; 29/419 R

[58] Field of Search ..... 29/33 R, 33 K, 33 D, 29/419, 624, 728; 228/148; 140/1

[56] References Cited

U.S. PATENT DOCUMENTS 3,236,083 2/1966 Linderoth, Jr. et al. ..... 29/33 D 3,540,114 11/1970 Roberts et al. ..... 29/419

3,556,167 1/1971 Nippert, Sr. ..... 140/1

*Primary Examiner*—Harrison L. Hinson

*Attorney, Agent, or Firm*—John G. Heimovics

[57] ABSTRACT

The method of forming a tow of filaments and the tow formed by said method wherein a bundle of elongated elements, such as rods or wires, is clad by forming a sheath of material different from that of the elements about the bundle and the bundle is subsequently drawn to constrict the elements to a desired small diameter. The elements may be formed of metal. The bundle may be annealed, or stress relieved, between drawing steps as desired. The sheath may be formed of metal and may have juxtaposed edges thereof welded together to retain the assembly. The sheath is removed from the final constricted bundle to free the filaments in the form of tow.

5 Claims, 16 Drawing Figures

UNCOIL-ING
.064
8 B+S
REDUCER
.0319
COILER
HOT WATER CLEAN
COIL FEED
ANNEAL
COILER
CLEAN + BORAX
UNCOIL-ING
.0319
REDUCER
.007
WIND ON 50# SPOOLS
TWISTER
STRESS RELEIVE OVEN
LEACH
RINSE
DETECTOR
WIND TO WEIGHT

APPARATUS FOR PRODUCING FINE METAL FILAMENTS

CROSS-REFERENCE TO CO-PENDING APPLICATION

This application is a divisional application of co-pending U.S. application Ser. No. 811,780 filed Apr. 1, 1969, now U.S. Pat. No. 3,977,070.

BACKGROUND OF THE INVENTION

1. Field of the Invention

This invention relates to manufacture of fibers or filaments, and particularly to the manufacture of metal fibers or filaments.

2. Description of the Prior Art

There has long been a need for low cost metal fibers as substitutes for conventional textile materials and in numerous other applications where the desirable chemical and physical characteristics of such metal fibers provides improved functioning and features heretofore unavailable. Recently, an improved process for forming metal fibers has been developed by the assignee hereof based on the novel concepts of the U.S. Pat. issued Oct. 11, 1966 to Webber et al, No. 3,277,564, for a "Method of Simultaneously Forming a Plurality of Filaments", and Roberts et al, issued July 23, 1968, No. 3,394,213, for a "Method of Forming Filaments", each of these patents being owned by the assignee hereof. The development of such fiber forming technology has provided a substantially new field of fiber products by reducing the theretofore exorbitant cost of such metal fibers to a reasonable value. Whereas prior to the technology developed by the assignee hereof the cost of such metal fibers was measured in the hundreds of dollars per pound, the cost today has been reduced to a small fraction thereof.

Broadly, the technique so developed by the assignee hereof in economically manufacturing extremely small diameter metal filaments has been to constrict a plurality of originally relatively large metal elements, such as wires or rods, concurrently whereby a multiplicity of constricting operations is effected by a single operation. Thus, as disclosed in the above identified Webber et al patent, one method of forming such filaments is to sheath a plurality of wires in a suitable sheathing material, bundle a plurality of sheathed wires in a suitable housing, or can, and draw the housed bundle through a plurality of drawing steps to the final desired size. To provide extremely small diameter filaments, a rebundling of the drawn bundles may be effected. Resultingly, the final drawing operation may involve the drawing of a million or more such previously constricted wires. By concurrently drawing such a large number of wires in the final workpiece, substantial economies may be effected in the production of the small diameter filaments.

The above mentioned Roberts et al patent teaches a modification of the Webber et al process in utilizing a hot forming operation prior to the drawing operation thereby providing different metallurgical and operational characteristics. As a concomitant of the improved characteristics obtained, further reduction in the cost of the manufacture of the filaments may be realized by utilization of the relatively low cost hot forming initial steps. Thus, the Roberts et al technology provided further improvement in the reduction of the cost of the fibers as manufactured by the assignee hereof.

The filaments and fibers produced in conformity with the teachings of these patents have been recognized by those skilled in the art as superior filaments. The prior techniques of forming metal fibers, such as steel wool and the like, wherein metal pieces are scraped or otherwise machined from metal blocks or sheets, produces ragged, nonuniform fibers, which are substantially inferior to the controlled geometric fibers obtained by the Webber et al and Roberts et al patent techniques. The prior art techniques, however, have had one advantage in that they produce fibers at relatively low cost.

SUMMARY OF THE INVENTION

The present invention is directed to a further improved method of forming metal fibers further reducing the cost of the fibers while yet providing the highly desirable accurately controlled drawn type fibers of the above discussed Webber et al and Roberts et al patents. The present invention comprehends such an improved form of metal fibers wherein a plurality of metal elements are sheathed in a suitable removable material and assembled within a sheet of metal which is formed about the assembly to define an enclosure. The metal sheet is retained about the assembly by suitably welding together juxtaposed edges of the sheet. The weld is effected so as to extend only partially through the thickness of the sheet to avoid effecting the metallurgical characteristics of the sheathed elements therein. The enclosed assembly is then constricted as by drawing, to cause the sheet to have a substantially continuous tubular configuration and further cause the elements to become reduced in cross-section to define the desired small diameter fibers. The constricting may comprise a plurality of drawing steps with the drawn assembly being suitably annealed between the steps to permit facilitated constriction to the final desired size. The operation may be effectively continuous as the original elements may comprise wires fed from suitable rolls with the outer housing, or cladding metal comprising a strip similarly provided from a roll and fed longitudinally during the forming of the sheet around the assembled wires. The wires may comprise previously sheathed wires or may be sheathed by providing suitable strips of sheathing material for encircling each of the wires as it is fed to the position wherein the outer sheet is formed about the bundled arrangement of sheathed wires. The original wires may have a relatively small diameter, such as one-quarter inch, for improved economy of manufacture. The individual sheathed wires may be formed into rolls upon completion of the cladding operation for subsequent bundling as discussed above. The number of sheathed wires in the bundle may be varied as desired.

BRIEF DESRIPTION OF THE DRAWING

Other features and advantages of the invention will be apparent from the following description taken in connection with the accompanying drawings wherein.

Figure 4A:
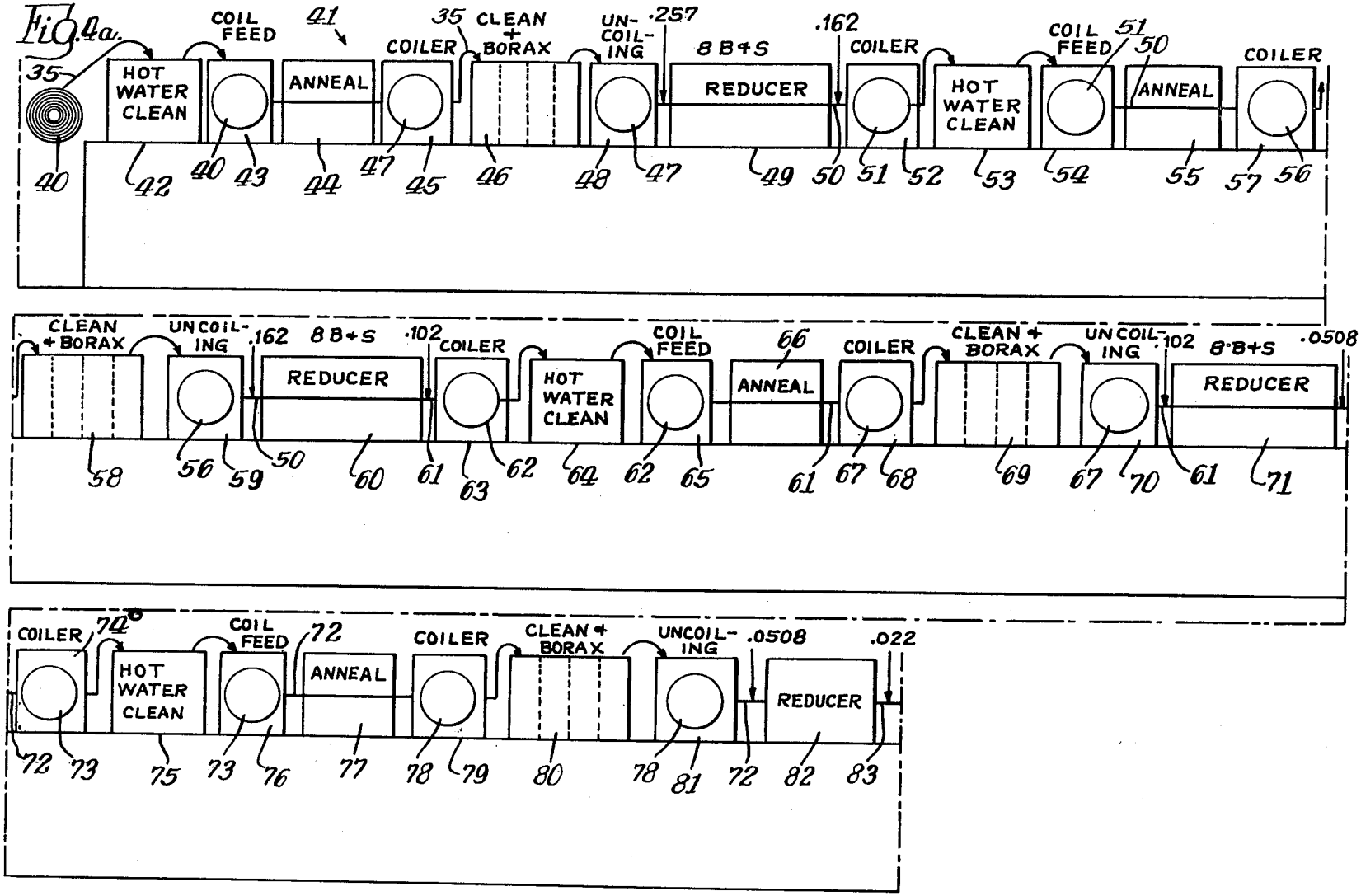
Figure 4B:
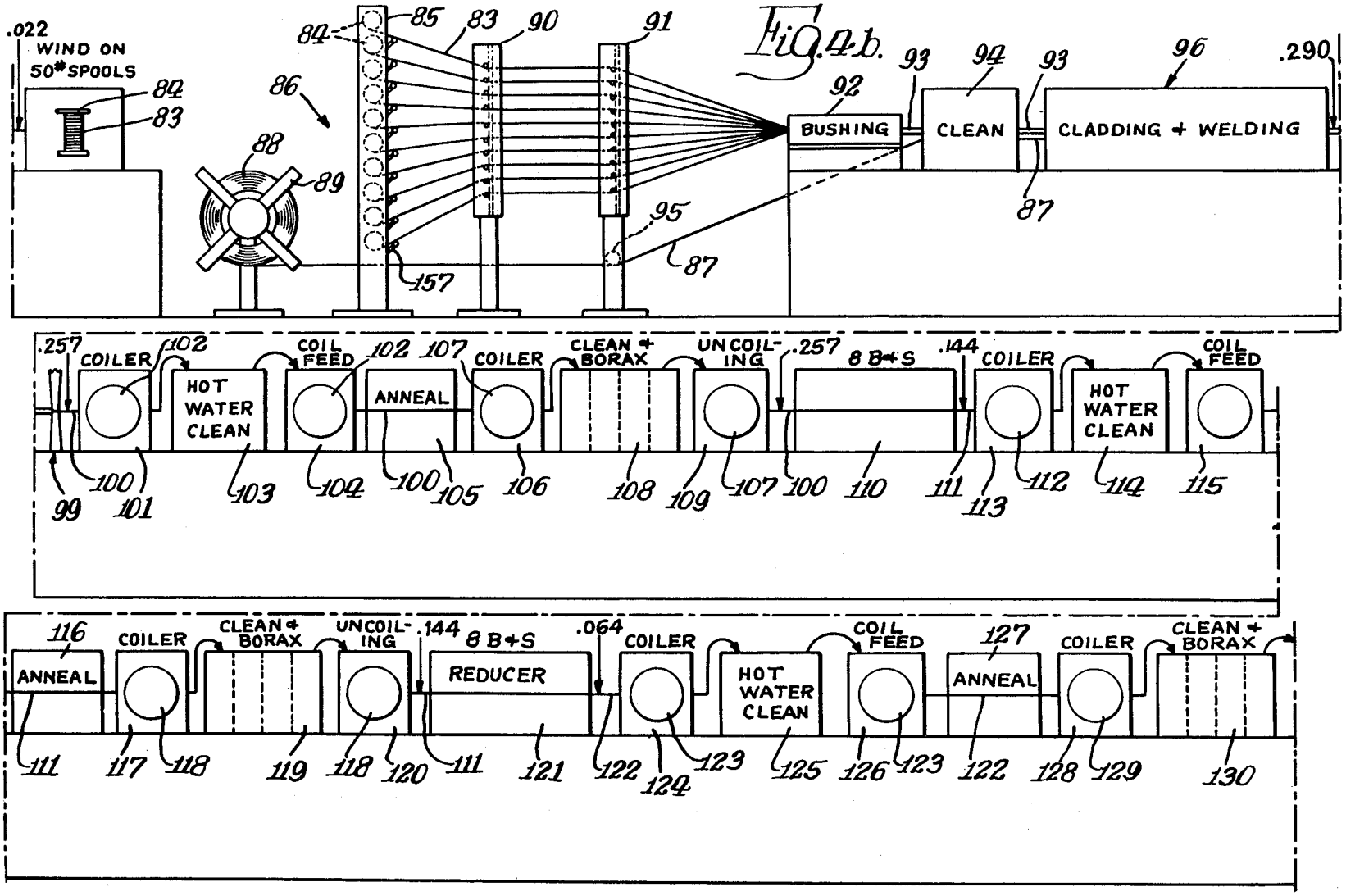
Figures 4C, 5, 6, 7, 8:
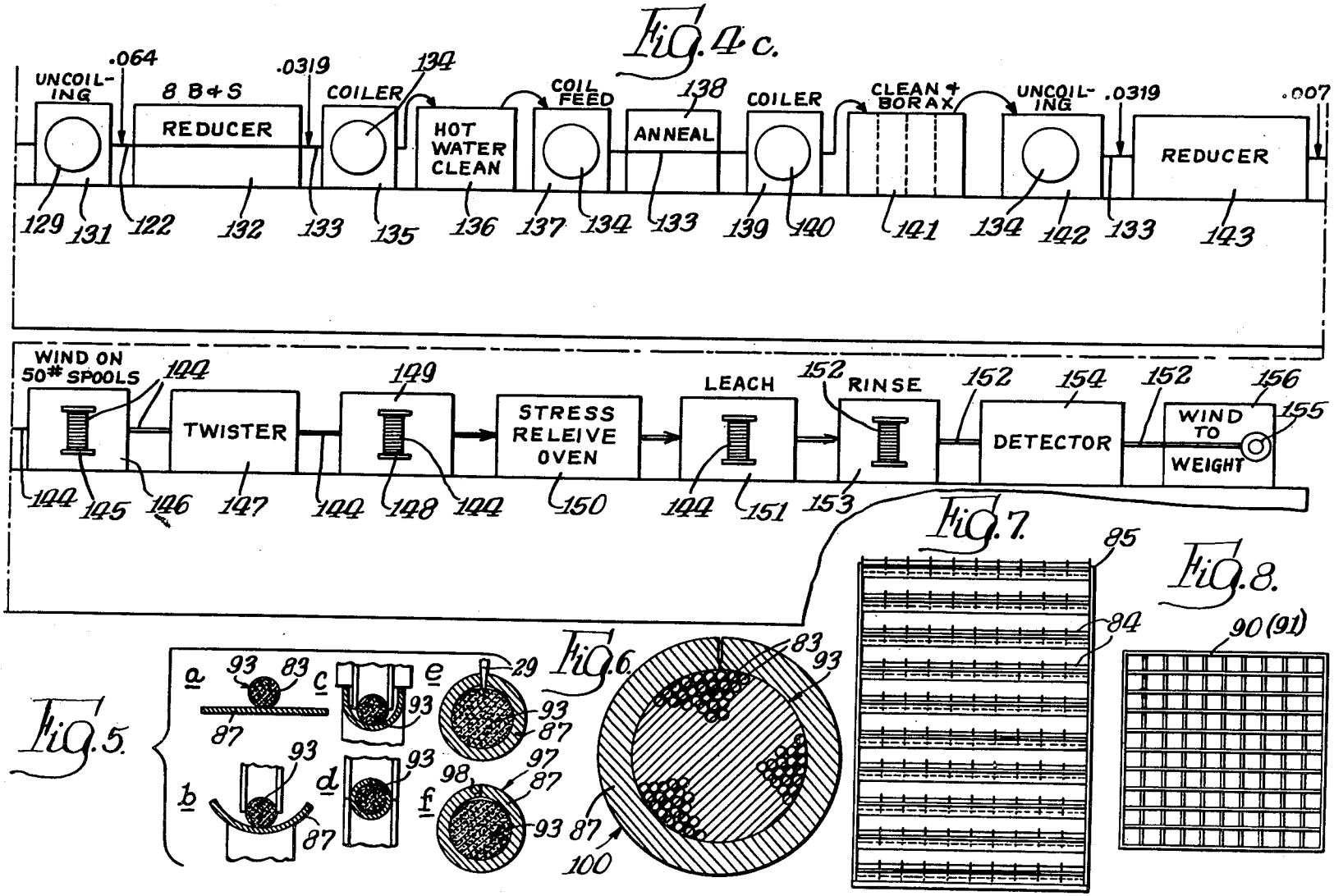

FIG. 4*a* is a schematic side elevation of an apparatus for reducing the diameter of the sheathed wire;

FIG. 4*b* is a schematic side elevation of an apparatus for cladding and reducing the diameter of a bundle of such sheathed wires;

FIG. 4*c* is a schematic side elevation of the final portion of the apparatus of FIG. 4*b;*

FIG. 5 is a series of cross-sections of the bundled sheathed wires at different stages in the cladding operation;

FIG. 6 is an enlarged cross-section of the clad bundle of sheathed wires;

FIG. 7 is a front elevation of the spool supply rack of the apparatus of FIG. 4*b;*

FIG. 8 is a front elevation of the guide plates of the apparatus of FIG. 4*b;*

Figure 9:
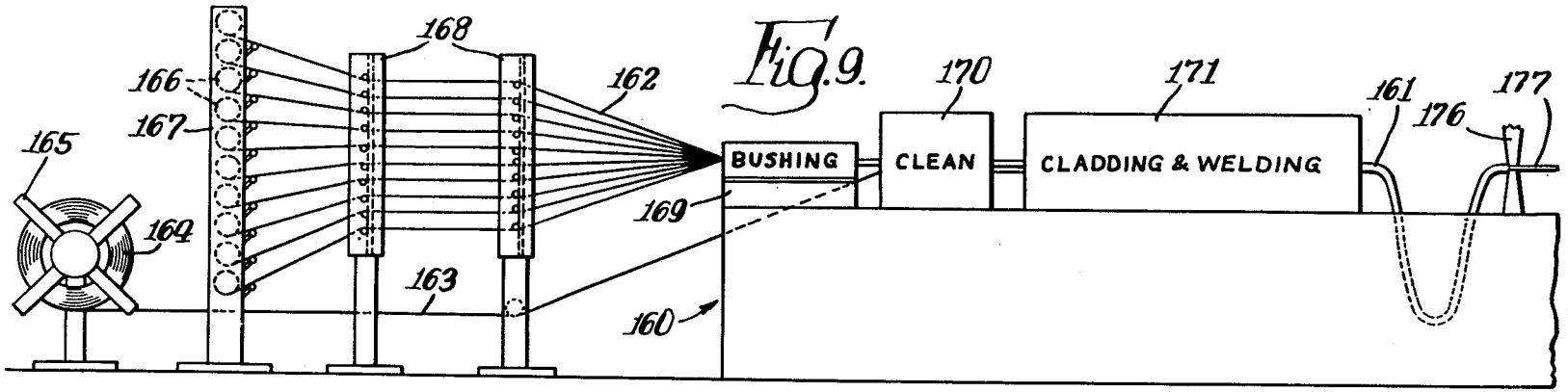
Figure 11:
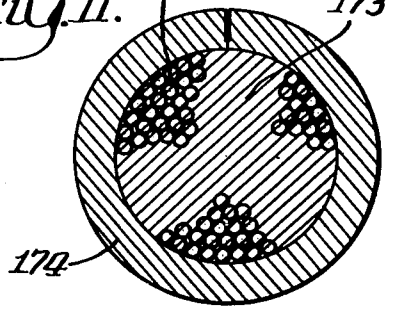
Figure 10:
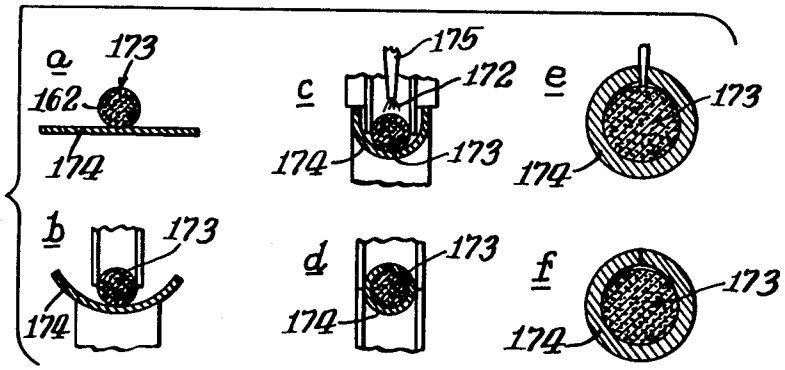
Figure 12:
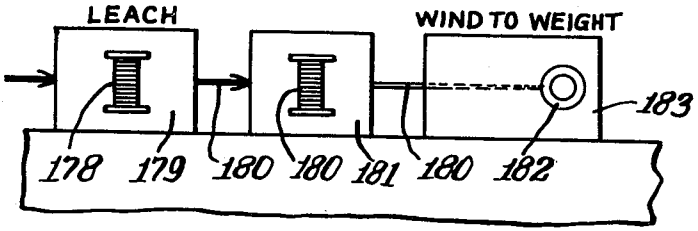
Figure 13:
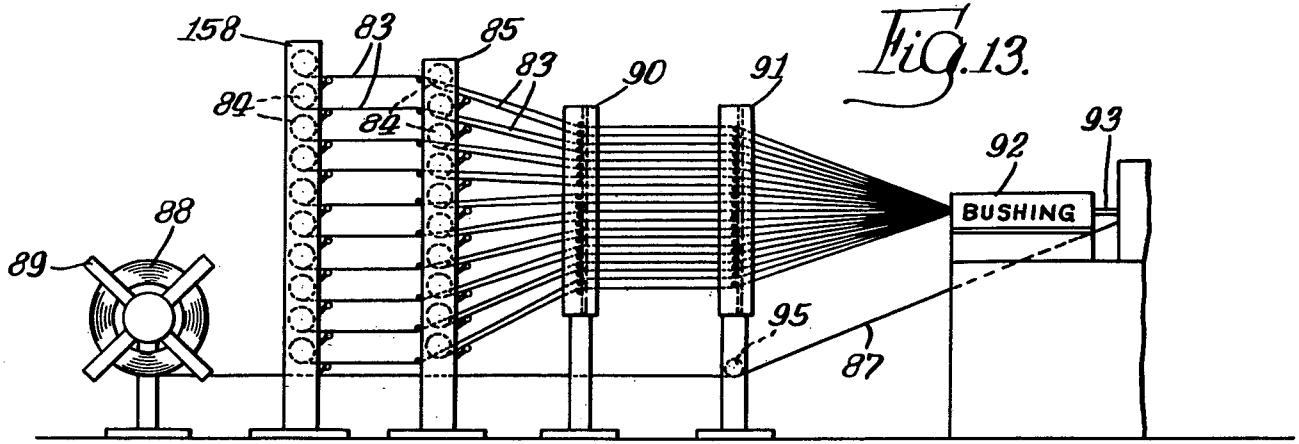
Figure 14:
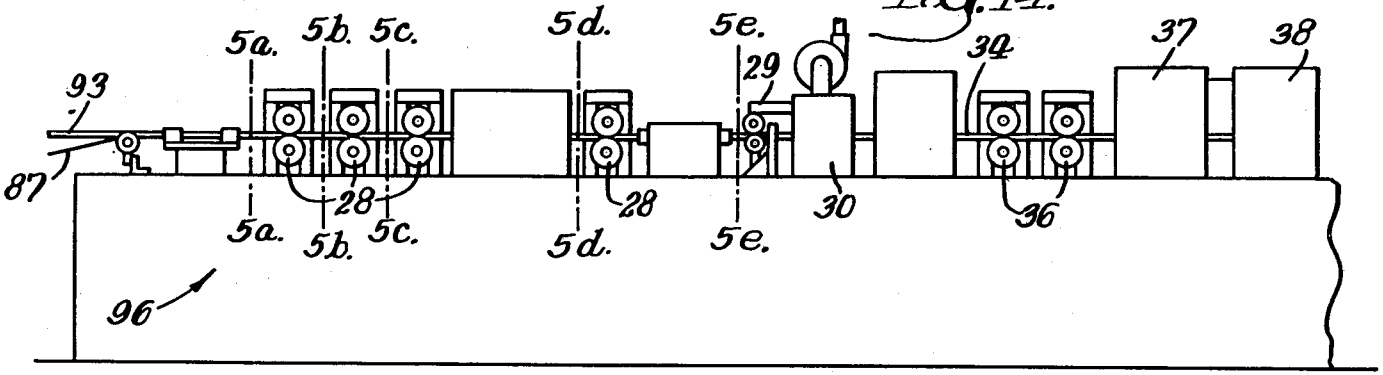

FIG. 9 is a schematic side elevation of a modified form of apparatus for cladding a bundle of wires disposed in a lubricant matrix;

FIG. 10 is a series of cross-sections of the bundled wires at different stages in the provision of the lubricant matrix and cladding thereof;

FIG. 11 is an enlarged cross-section of the clad bundle of wires in the lubricant matrix;

FIG. 12 is a schematic side elevation of an apparatus for removing the bundle sheath and the lubricant matrix material from the filaments;

FIG. 13 is a fragmentary schematic side elevation of a modified form of apparatus for cladding a bundle of wires having a plurality of supply racks to provide an increased number of wires in the bundle; and FIG. 14 is a schematic side elevation of the cladding and welding apparatus.

DESCRIPTION OF THE PREFERRED EMBODIMENT

In the exemplary embodiment of the invention as disclosed in the drawing, a plurality of small diameter filaments generally designated 10 are formed by an improved economical drawing process wherein the forming of the filaments may be effectively continuous while yet providing high accuracy and control of the filament configuration and metallurgical characteristics. As indicated above, the invention comprehends the forming of the plurality of filaments by drawing down a plurality of wires 11 which have been suitably sheathed in a material permitting ready separation of the material from the constricted filaments upon completion of the drawing operation. The process permits the drawing of all types of drawable materials, such as drawable metals. In illustrating the invention, the wire 11 is illustrated as a stainless steel wire. The individual wires are clad in a suitable sheathing material which may be provided in the form of strip 12. The sheathing material may comprise any suitable material compatible with the wires 11 and which may be separated from the wires 11 upon completion of the drawing operation. Illustratively, the strip 12 may be formed of a drawable metal such as Monel metal where the wires are formed of stainless steel and, thus, the sheathing material may be separated from the formed filaments by a leaching operation such as one utilizing nitric acid to dissolve the Monel metal while leaving the stainless steel substantially unaffected.

Figures 1, 2, 3:
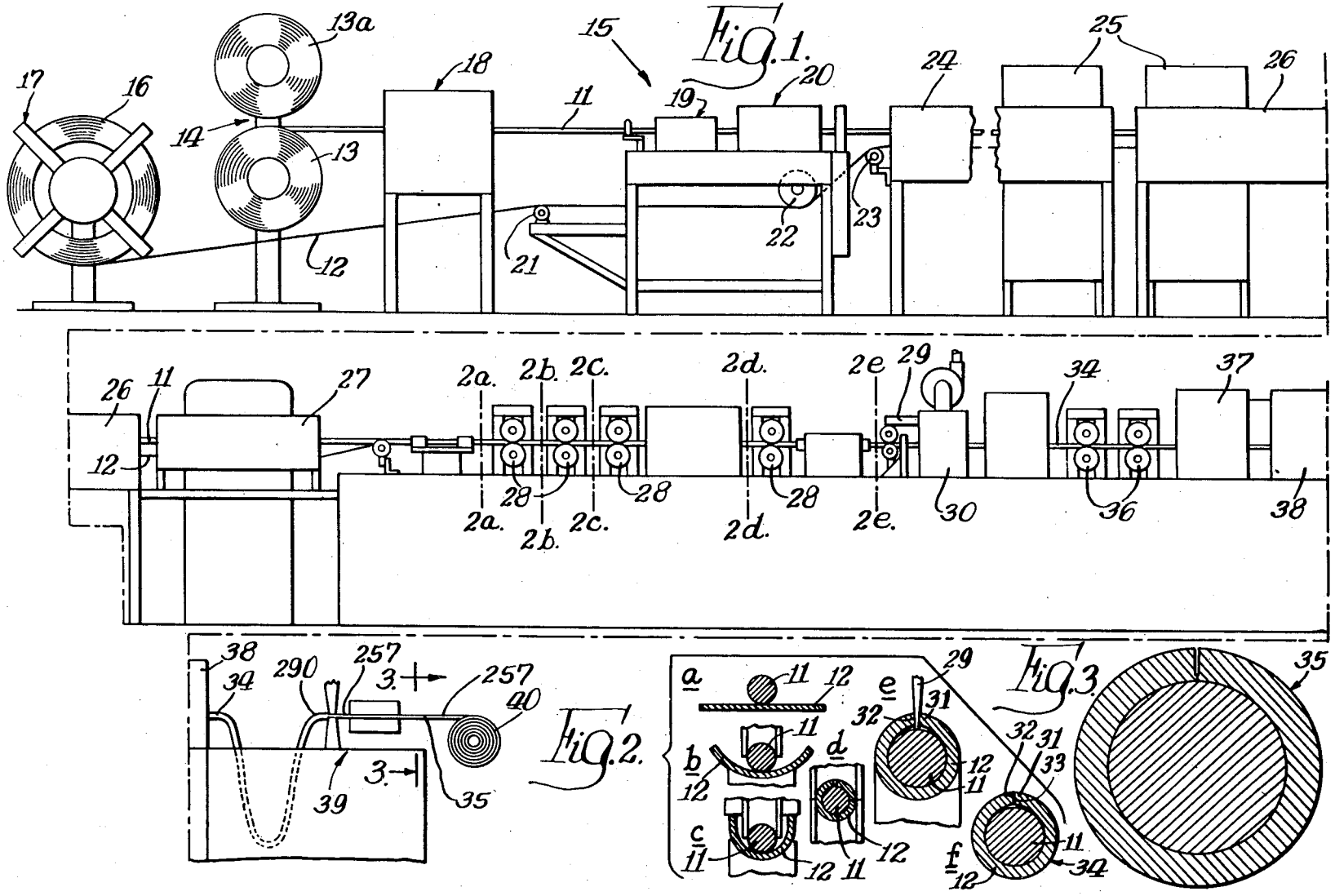
FIG. 1 is a side elevation of a single end cladding apparatus wherein a single wire is sheathed by cladding a strip thereabout.
FIG. 2 is a series of cross-sections of the single end at different stages in the cladding operation.
FIG. 3 is an enlarged cross-section of the sheathed wire.

Referring now to FIG. 1 of the drawing, the original metal elements are preferably of economically commercially available small diameter size and illustratively herein comprise ¼ inch diameter stainless steel wires 11 provided in the form of a roll 13 which may be mounted on a suitable coil unreeler generally designated 14. As shown in FIG. 1, a reserve supply roll 13*a* may be provided on the coil unreeler 14 to permit facilitated end-to-end connection and thusly effectively continuous feed of the wire to an apparatus generally designated 15 for cladding the wire. The cladding material, or strip, 12 may be provided in the form of a roll 16 which may be mounted on a suitable strip unreeler generally designated 17 for concurrent feed with the wire 11. The strip 12 illustratively may comprise an 0.018 inch to 0.020 inch thick by 0.80 inch wide strip for cladding, or sheathing, the ¼ inch wire 11.

The wire 11 may firstly be fed through a wire welder 18 wherein the tail end of an expiring roll may be welded to the forward end of a new roll, such as rolls 13 and 13*a* respectively, by suitably welding the ends in abutting end-to-end relationship. During the normal delivery of the wire from the roll, the wire merely passes unaffectedly through the welder 18.

From the welder 18, wire 11 is delivered through an oiler 19 and a straightener 20. As seen in FIG. 1, the strip 12 may be delivered by suitable guide rolls 21, 22 and 23 into a cleaning tank 24; the wire 11 being concurrently fed to the cleaning tank 24. Illustratively, the wire and strip may be subjected in tank 24 to an aqueous cleaning solution. The apparatus 15 may include suitable hot water heater 25 for delivering the cleaning water to the tank 24 at a relatively high temperature for improved efficiency of cleaning. From the cleaning tank 24, the wire and strip are delivered to a rinsing tank 26 wherein the cleaning solution is thoroughly rinsed from the wire and strip. The treatment of the wire with an aqueous cleaning solution is illustrative only, it being understood that any suitable method of cleaning the wire and strip may be utilized within the scope of the invention. The cleaned and rinsed wire and strip may be dried in a suitable dryer 27.

The cleaned and dry wire and strip are next delivered to a plurality of strip forming rolls 28 which form the strip 12 about the wire 11 suitably to sheath, or clad, the wire. The several stages of forming of the strip about the wire are illustrated in FIG. 2. Thus, in the initial form, the strip is brought into subjacent tangency with the wire while in substantially flat form. In a first set of rolls the strip is formed concavely upwardly partially about the wire 11. Subsequently, the rolls further deform the strip 12 into substantially encircling relationship as shown in FIG. 2*a*. As shown in FIG. 2*e*, the encircling sheath is guided by a suitable knife guide 29 which maintains the juxtaposed edges of the encircling sheath in an uppermost position for accurate alignment with a welder 30 which welds together the juxtaposed edges 31 and 32 with a weld 33 extending less than fully through the thickness of the formed strip. Illustratively, the weld may extend 95 percent through the strip and may comprise a series of spot welds spaced longitudinally of the strip at preselected distances assuring proper retention of the strip 12 in the encircling relationship to the wire for subsequent forming operations. If desired, the weld may comprise a continuous weld. The depth of the weld is preselected to preclude affecting the metallurgical characteristics of the wire 11 from the heat of the weld whereby a uniform filament structure is obtained in the final product. As shown in FIG. 2*e*, the edges 31 and 32 of the strip are closely juxtaposed at the time of welding and the knife guide 29 is made to be thin to preclude separation of the edges.

The partially sheathed wire generally designated 34 may have a slight looseness of the sheath 12 on the wire 11 as illustrated in FIG. 2*f*. The apparatus 15 further includes means for reducing the partially sheathed wire 34 to define a firmly clad welded sheathed wire 35 as shown in FIG. 3. Thus, from the welder 30, the partially sheathed wire 34 is delivered through suitable sizing rolls 36, an apparatus for detecting the quality of the welds generally designated 37 and which herein may comprise an eddy current detector apparatus, and a spray apparatus 38 for spraying improperly welded portions of the partially sheathed wire 34 for subsequent identification and discarding or rewelding thereof. The partially sheathed wire 34 is next delivered to a single capstan bull-block apparatus 39 for reduction of the diameter of the partially sheathed wire 34 by 1 Brown & Sharpe reduction to define the clad wire 35 which may be formed into a suitable coil 40 which may have a total weight of approximately 600 lbs. Illustratively, the outside diameter of the partially sheathed wire 34 may be approximately 0.290 inch and the outside diameter of the sheathed wire 35 may be 0.257 inch.

The wires may be clad in apparatus 15 at relatively high speed such as approximately 15 ft. per minute. Greater speeds may be obtained by utilization of a plurality of welding devices 30; illustratively, it has been found that if two welding devices 30 are employed, the speed may be increased to approximately 40 to 50 feet per minute. As the bull-block 39 reduces the diameter of the sheathed wire and correspondingly increases the length thereof, the rate of take-up on the roll 40 is greater than the rate of feed through the apparatus 15. Illustratively, where the feed through apparatus 15 is 15 ft. per minute, the take-up on the roll 40 is approximately 20 ft. per minute.

Prior to the bundling operation, it is desirable to reduce the diameter of the sheathed wire 35 for improved efficiency in the multiple end drawn process. Thus, as shown in FIG. 4*a*, the roll 40 of sheathed wire 35 may be provided to a subsequent apparatus generally designated 41 to effect such further reduction in the diameter thereof. Apparatus 41 includes a cleaning apparatus 42 which may comprise an apparatus for rinsing the wire 35 in relatively hot water. The cleaned wire is then fed by means of a coil feeding device 43 through a suitable annealing furnace 44 into a coiler apparatus 45 wherein the annealed 0.257 inch diameter sheathed wire is suitably coiled.

The coiled wire may be further treated in a subsequent cleaning and boraxing apparatus 46 wherein the coil 47 is dipped in an alkaline solution, rinsed with cold water, rinsed with hot water such as at approximately 200° F., and coated with borax to provide surface lubrication in the subsequent reducing operation. The cleaned and boraxed coated, coiled wire is then delivered to an uncoiling apparatus 48 which feeds the wire through a drawing apparatus 49 to reduce the diameter thereof 8 Brown & Sharpe reductions from a 0.257 inch to a 0.162 inch diameter. The sheathed wire may be fed through this portion of apparatus 41 at a speed of approximately 400 ft. per minute. The reduced wire 50 is then formed into a coil 51 in a suitable coiler apparatus 52.

Coil 51 may be suitably cleaned in hot water rinse apparatus 53 and delivered to a coil feed apparatus 54 which feeds the wire through an annealing furnace 55 at a speed of approximately 22 ft. per minute. The annealed wire 50 is then wound onto a coil 56 in a suitable coiler apparatus 57 and the coil 56 then delivered to a cleaning and boraxing apparatus 58. The cleaned and boraxed coil 56 is then delivered to an uncoiler 59 which feeds the 0.162 inch diameter wire 50 therefrom through a drawing apparatus 60 which effects an 8 Brown & Sharpe reduction to a 0.102 inch diameter wire 61. The wire 61 is then formed into a coil 62 by means of a coiler apparatus 63 and the coil 62 is cleaned in a suitable hot water rinsing apparatus 64. The cleaned roll is then fed by a coil feed apparatus 65 through an annealing furnace 66 at the rate of approximately 400 ft. per minute and then wound into a coil 67 by means of a suitable coiler apparatus 68. The coil 67 is then cleaned and boraxed in a suitable cleaning and boraxing apparatus 69 and the wire is fed from the cleaned and boraxed coil by means of a suitable uncoiling apparatus 70 to a suitable drawing apparatus 71 wherein the 0.102 inch diameter sheathed wire is reduced 8 Brown & Sharpe reductions to an outer diameter of 0.0508 inch. The 0.508 inch diameter wire 72 is then formed into a coil 73 in a suitable coiler 74 and the coil 73 cleaned in a suitable hot water rinse apparatus 75. The wire 72 is then fed from the roll 73 by means of a coil feeding apparatus 76 through an annealing furnace 77 at the rate of approximately 57 ft. per minute to effect suitable annealing of the wire 72 for subsequent further reduction. The annealed wire is then formed into a coil 78 by a coling apparatus 79 and the coil 78 is cleaned and boraxed in a cleaning and boraxing apparatus 80. The wire 72 is then fed from the coil 78 by an uncoiling apparatus 81 to a drawing apparatus 82 which effects a reduction of the 0.0508 inch diameter wire 72 to approximately 0.022 inch. The 0.022 inch diameter wire 83 is then wound on suitable spools 84 for subsequent multiple end drawing. Illustratively, each spool 84 may contain approximately 50 pounds of the 0.022 inch diameter wire 83.

Referring now to FIG. 4*b*, a plurality of spools 84 of the 0.022 inch diameter single end clad wire 83 are placed on a rack 85 of a multiple end drawing apparatus generally designated 86 for delivery of the wire into bundled association with a bundle sheathing sheet, or strip, 87.

Any suitable number of wires 83 may be bundled and in the illustrated embodiment, 91 spools 84 are provided on the rack 85 for delivering 91 wires 83 through a pair of guides 90 and 91 to a gatherer bushing device 92 which arranges the wires 83 in a 91 hexagonal array bundle 93. Illustratively, strip 87 may be provided in the form of a roll 88 on a strip unreeler 89. For use with such a 91 end bundle, the sheathing strip comprises a strip 0.018 inch to 0.020 inch wide by 0.80 inch thick.

The wire bundle 93 is next delivered to a cleaning apparatus 94 which cleans the bundled wire with suitable hot water. The strip 87 is directed by means of guides 95 to the cleaning apparatus 94 for concurrent cleaning thereof with the bundled wires. The cleaned bundled wires 93 and strip 87 are next delivered to a cladding and welding apparatus generally designated 96. Apparatus 96, as shown in FIG. 14, is arranged to form strip 87 about the wire bundle 93 as illustrated in FIG. 5. Apparatus 96 may be similar to the cladding and welding means of apparatus 15 including strip forming rolls 28, knife guide 29, welder 30, weld detector 37, and spray device 38. Thus, as shown in FIG. 5, the bundle 93 of single end clad wires 83 is juxtaposed to the flat strip 87 and the strip is then formed concavely about the bundle to form the partially completed sheathed bundle 97 shown in FIG. 5*f*. As shown, the weld 98 extends less than fully through the thickness of the sheath strip 87. The outside diameter of the partially formed sheathed bundle 97 may be approximately 0.290 inch. The sheathed bundle 97 is delivered to a single capstan bull-block apparatus generally designated 99 which reduces the diameter to approximately 0.257 inch to define a firmly clad welded sheathed bundle 100 as shown in FIG. 6. The sheathed bundle 100 may be delivered to a coiling apparatus 101 wherein the sheathed bundle is formed into a suitable coil 102. The coil 102 is delivered to a cleaning apparatus 103 wherein the bundle is rinsed with hot water. The coil 102 is then delivered to a coil feeding apparatus 104 which feeds the sheathed bundle 100 to an annealing furnace 105 at a temperature of approximately 1900° F. The annealed sheathed bundle 100 is delivered to a coiler apparatus 106 wherein the annealed 0.257 inch diameter sheathed bundle is suitably coiled to define a coil 107.

The coil 107 is cleaned and boraxed in an apparatus 108 wherein it is dipped in an alkaline solution, rinsed with cold water, rinsed with hot water, such as at a temperature of approximately 200° F., and coated with borax. The cleaned and boraxed coated coil 107 is delivered to an uncoiling apparatus 109 which feeds the sheathed bundle 100 through a drawing apparatus 110 to reduce the diameter thereof to 0.144 inch. The reduced sheathed bundle 111 is formed into a coil 112 in a suitable coiler apparatus 113.

The coil 112 is suitably cleaned in a hot water rinse apparatus 114 and then delivered to a coil feed apparatus 115 which delivers the sheathed bundle 111 through an annealing furnace 116 to a suitable coiler apparatus 117 wherein the sheathed bundle is formed into a coil 118. The coil 118 is delivered to a cleaning and boraxing apparatus 119 wherein it is cleaned and boraxed as in apparatus 108. The coil 118 is delivered to an uncoiling apparatus 120 which feeds the 0.144 inch diameter sheathed bundle 111 to a drawing apparatus 121 which effects an 8 Brown & Sharpe reduction in the diameter thereof to 0.064 inch. The further reduced sheathed bundle 122 is formed into a coil 123 in a coiler apparatus 124 and the coil 123 is suitably cleaned in a hot water cleaning apparatus 125. The cleaned coil 123 is delivered to a coil feeding apparatus 126 which delivers the sheathed bundle 122 through an annealing furnace 127 to a coiler apparatus 128 wherein the annealed sheathed bundle 122 is formed into a coil 129.

Coil 129 is cleaned and boraxed in a cleaning and boraxing apparatus 130 and delivered to an uncoiling apparatus 131 which feeds the 0.064 inch diameter sheathed bundle 122 through a drawing apparatus 132 which effects an 8 Brown & Sharpe reduction to 0.0319 inch. The reduced diameter sheathed bundle 133 is formed into a coil 134 in a coiling apparatus 135 and the coil 134 is delivered to a hot water cleaning apparatus 136. The cleaned coil 134 is delivered to a coil feed apparatus 137 which feeds the clean sheathed bundle 133 through an annealing furnace 138 to a coiler 139 which forms the annealed sheathed bundle 122 into a coil 140. The coil 140 is cleaned and boraxed in a suitable cleaning and boraxing apparatus 141 and the cleaned and boraxed coil 134 is delivered to an uncoiling apparatus 142 which feeds the 0.0319 inch diameter annealed sheathed bundle 133 through a drawing apparatus 143 wherein the sheathed bundle 133 is reduced to a diameter of 0.007 inch.

The 0.007 inch diameter sheathed bundle 144 is wound onto suitable spools 145 in a suitable spooling apparatus 146.

When desired, the constricted sheathed bundle 144 may be provided with a twist in a suitable twister 147. Illustratively, the twister 147 may provide a standard manufacturer's twist of a small number of turns per inch. The sheathed bundle 144, either twisted or untwisted as desired, may be wound onto suitable leaching spools 148 in a suitable winder 149 and if desired, the sheathed bundle may be stress-relieved in a suitable stress-relieving oven 149 by placement of the wound spools 148 therein for a suitable period of time.

The sheathing material may be removed from the sheathed bundle by any suitable process. Illustratively, where the wire sheath 12 and the bundle sheath 87 are formed of Monel metal and the wires are formed of stainless steel, the sheathing material may be removed by a leaching process wherein the spooled sheathed bundles 144 are subjected to hot nitric acid in a suitable autoclave apparatus 151. The spooled leached bundle 144 effectively defines a spool of filamentary tow 152 which may be suitably rinsed in a rinsing apparatus 153 to remove the leaching acid. The tow 152 is delivered through a leach detector 154 which determines the completeness of the leaching operation. Incompletely leached tow may be returned to the leaching apparatus 151 to assure a complete removal of the sheath material from the spooled bundle.

The fully leached tow 152 may be then wound to weight on suitable supports, such as cardboard tubes 155 in a suitable winding apparatus 156.

The invention comprehends the forming of the clad wires which make up the bundle 100 by other suitable methods in addition to the cladding method disclosed in FIG. 1. Further, the invention comprehends the individual sheathing of the wires in the sheathed bundle 100 by other suitable sheathing methods. Illustratively, as seen in FIG. 9, a modified apparatus generally designated 160 may be provided for forming sheathed bundles 161 of wires 162 wherein the outer sheath is formed from a strip 163 of metal. As in apparatus 86, the strip 163 may be provided from a roll 164 thereof carried on a roll stand 165. The wires 162 may comprise unsheathed wires having a suitable diameter such as 0.022 inch diameter wires. The wires 162 may be provided in the form of coils 166 carried on a spool rack 167 and suitably guided by guides 168 to a collecting bushing 69. The wires 162 and strip 163 may be cleaned in a suitable cleaning apparatus 170 and delivered to a cladding and welding apparatus 171 wherein the bundled wires 162 are sheathed in the strip 163 in a manner generally similar to the sheathing of the bundled wires 83 in apparatus 86. However, in the apparatus 171, the wires 162 may be sheathed by introduction of a lubricant, such as oil 172, into the bundle 173 in sufficient quantities to separate each of the wires from each other. The lubricating material may be introduced into the bundle 173 therewith at a point prior to the closing up of the outer sheath 174 thereabout. Illustratively, as shown in FIG. 11, the bundles 173 may be sprayed with the lubricant 172 by means of a conventional spray head 175 where the sheath 174 is formed into a generally U-shaped configuration similar to that of FIG. 5c.

The sheathed bundle 161 may be suitably constricted by a single capstan bull-block apparatus 176 to provide a constricted sheathed bundle 177 having an outside diameter of 0.257 inch. The bundle may then be suitably constricted as by apparatus similar to the portion of apparatus 86 subsequent to the single capstan bull-block apparatus 99 and up to the leaching apparatus 151. Sheath 174 may be removed as by subjecting the finally constricted sheathed bundle to a leaching operation as in a leaching apparatus 179 sufficient to remove the outer sheath 174. If desired, the oil 174 may be removed from the individual filaments of the resultant tow 180 by subjecting the tow to a suitable oil solvent in a suitable oil removing apparatus 181. The tow 180 may be wound to weight on suitable means such as cardboard tubes 182 in a suitable winding apparatus 183.

The spool rack 85 may be suitably designed to hold any desired number of spools 84. To provide improved control of the manufacturing operation, the rack may be provided with a plurality of switches 157 for sensing the presence of the wires 83 for automatically discontinuing operation of the apparatus upon runout of a given spool.

The rack 85 is adapted to hold up to 100 wires in 10 rows of 10 each. Where the number of wires to be bundled is greater than 100, a second rack 158 may be provided for carrying the additional spools 84. As shown in FIG. 13, where an additional rack, or racks, are employed, the wires 83 from the spools thereon may pass through the rack 85 to the guides 90 and 91.

In illustrating the invention, the wire has been described as stainless steel wire. One excellent wire for such filament formation comprises conventional Type 304 stainless steel. The parameters described above relative to the temperatures, etc., relate to the use of such 304 stainless steel wires and, as will be obvious to those skilled in the art, suitable changes in the parameters may be made to accommodate other wire material. Illustratively, the process is advantageously adapted for use in forming filaments of super-alloys, such as NBSA Karma, tantalum, niobium, and other suitable drawable metals. Illustratively, where the filaments are formed of tantalum, the cladding strip may be formed of copper.

The final diameter of the filaments of the tow produced by the above described process may be extremely small, such as 1 micron, or less. By rebundling the sheathed bundle prior to the final leaching operation, a corresponding increase in the number of wires in the final sheathed bundle may be obtained. Illustratively, the process has been utilized in forming a final tow of over 250,000 filaments.

The above described process has the highly desirable advantages of permitting substantially continuous production of extremely small diameter fibers, or filaments, from common, relatively low cost wire material. The individual steps of the process are simple and utilize relatively simple apparatus. Thus, the resultant final cost of the small diameter filaments is substantially reduced over the known processes for forming such filaments. The process permits the use of a smooth rolled strip for cladding the individual wires and the bundled sheathed wires. Thus, the life of the drawing apparatus dies is substantially extended, further minimizing the cost of production. Where the particular material being drawn may be reduced with either a greater or lesser amount of reduction per die pass, a corresponding change in the number of drawing apparatuses may be utilized. Where the material may be more greatly reduced in each die pass, such as with the super alloy Karma, the reduction in the number of drawing steps and the number of annealing steps provides a substantial reduction in the cost of manufacture.

By accurately controlling the dimension of the cladding strip, the circularity of the sheathed bundle may be maintained highly accurately and, thus, the uniformity in the final configuration of the filaments is similarly highly accurately maintained. By eliminating initial hot forming steps, such as hot rolling, the circularity of the bundle and final filament is again more readily maintained as the drawing operation tends to provide substantially uniform constrictive forces on the bundle being drawn. As the size of the cladding strip may be suitably varied, any number of wires may be bundled as well as the hexagonal array numbers. Further, the cross-sections of the wires in the bundles may be varied by simply providing different diameter sheathed wires in the bundle prior to sheathing of the bundle. Illustratively, the shape of the wires may be varied to vary the shape of the final filaments as for improved weaving of the final fiber tow. The individual wires may have non-circular outer surfaces, which configurations will effectively be carried over into the final fibers, such as for improved surface adhesion.

Further as discussed above, the present invention, by eliminating the need for initial hot forming steps, effectively eliminates diffusion between the matrix material and the fiber material as occurs as a result of the maintaining of the bundle at relatively high temperatures for substantial periods of time in such initial hot forming steps. Thus, the bundle may have a small original outside diameter permitting the bundle to be constricted solely by cold drawing and annealing steps. This improved method of forming the fibers is permitted by the prior substantial reduction of the single end clad wires permitting them to be received within the relatively small diameter enclosing strip in preselected numbers which, as discussed above, may be over 250,000.

By effectively minimizing diffusion between the matrix and fiber material, improved facilitated freeing of the fibers from the matrix material in the leaching process is obtained. Further, the effective minimizing of such diffusion provides an improved uniform fiber structure wherein the metallurgical caharacteristics are accurately controlled. Still further, the improved process permits the use of relatively low cost carbide dies as a result of the ability to form relatively high numbers of fibers in the bundle.

The foregoing discosure of specific embodiments is illustrative of the broad inventive concepts comprehended by the invention.

We claim:

1. A machine combination used in producing a tow of fine metal filaments from a composite, each of said filaments initially comprising a metallic wire filament forming material surrounded by a constrictable sheathing material to prevent filament-to-filament contact until said sheathing material has been removed, said machine combination comprising:

(1) means for gathering a plurality of sheathed metal wires in a preselected array to form a compact bundle;

(2) means for forming a sheathing strip around said compact bundle, said strip having longitudinal edges;

(3) means for securing the edges of said strip to form and define a compact sheathed bundle wherein the sheathed metal wires are free from contact by said securing means and said sheathing strip being capable of removal from said bundle by means substantially unaffecting said wire filament material; and (4) means for reducing the diameter of said sheathed bundle to form the desired filament size in said composite.

2. The machine combination of claim 1 wherein said gathering means includes a plurality of sheathed wire filament guides and at least one collector bushing.

3. The machine combination of claim 1 wherein said forming means includes a plurality of forming rolls.

4. The machine combination of claim 1 wherein said securing means includes a knife guide adjacent the edges of said strip.

5. The machine combination of claim 1 wherein said securing means further includes a welder.

* * * * *